US006425361B1

(12) United States Patent
Motohashi

(10) Patent No.: US 6,425,361 B1
(45) Date of Patent: Jul. 30, 2002

(54) ROCKER ARM AND METHOD OF FABRICATING ROCKER ARM BODY

(75) Inventor: Nobutsuna Motohashi, Tokyo (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 09/576,645

(22) Filed: May 22, 2000

(30) Foreign Application Priority Data

May 31, 1999 (JP) ..... 11-151544
Aug. 16, 1999 (JP) ..... 11-229859

(51) Int. Cl.[7] ..... F01L 1/18
(52) U.S. Cl. ..... 123/90.41; 29/888.2
(58) Field of Search ..... 29/888.2; 72/379.2; 123/90.39, 90.41, 90.44

(56) References Cited

U.S. PATENT DOCUMENTS

| | | | | |
|---|---|---|---|---|
| 4,614,171 A | | 9/1986 | Malhortra | |
| 4,628,874 A | | 12/1986 | Barlow | |
| 4,829,647 A | | 5/1989 | Anderson et al. | |
| 5,016,582 A | | 5/1991 | Mills | |
| 5,325,825 A | | 7/1994 | Schmidt | |
| 5,535,641 A | | 7/1996 | Uchida et al. | |
| 5,642,693 A | | 7/1997 | Kotani | |
| 5,678,305 A | * | 10/1997 | Nagano | 29/888.2 |
| 5,720,245 A | | 2/1998 | Calka | |
| 5,774,984 A | * | 7/1998 | Kotani | 29/888.2 |
| 5,819,694 A | | 10/1998 | Trutescu et al. | |
| 5,887,474 A | * | 3/1999 | Cutshall | 72/315 |
| 6,070,561 A | * | 6/2000 | Greene | 123/90.36 |
| 6,199,527 B1 | * | 3/2001 | Okubo | 123/90.41 |

FOREIGN PATENT DOCUMENTS

| | | |
|---|---|---|
| DE | 19652676 | 6/1998 |
| DE | 19721210 | 11/1998 |
| GB | 2115898 | 9/1983 |
| JP | 3172506 | 7/1991 |
| JP | 4259611 | 9/1992 |
| JP | 06017614 | 1/1994 |
| JP | 11-270311 | 10/1999 |
| JP | 11-270312 | 10/1999 |
| JP | 2000-120411 | 4/2000 |

* cited by examiner

*Primary Examiner*—Thomas Denion
*Assistant Examiner*—Jaime Corrigan
(74) *Attorney, Agent, or Firm*—Jordan and Hamburg LLP

(57) ABSTRACT

A rocker arm, which opens and closes a valve when tilted by a cam and is provided on a cylinder head, has a body made of sheet metal. The body is constituted in such a manner that one metal plate blank is bent into a substantially U shape so that a pair of opposed side walls and connecting walls for connecting the side walls are provided. A convex valve fitting section is provided on the connecting walls of the body by press working including a non-uniform cross section process producing plastic flow of material.

12 Claims, 6 Drawing Sheets

A
A1
13
16
Y
B
C
D
E
11
ORIGINAL THICKNESS
FLOWING SECTION
COMPRESSION DEFORMED PORTION
COMPRESSION DEFORMED PORTION
FRAGMENTAL VIEW TAKEN ON THE LINE Y-Y OF FIG.5A

ROCKER ARM AND METHOD OF FABRICATING ROCKER ARM BODY

BACKGROUND OF THE INVENTION

The present invention relates to a rocker arm for opening and closing a valve which is tilted by a cam and provided on a cylinder head and a fabricating method thereof. More specifically, the present invention relates to the rocker arm having a body made of sheet metal and a fabricating method of the body.

A rocker arm formed of sheet metal is disclosed in Japanese Patent Application Laid-Open No. 4-259611 (1992). This rocker arm is of an end pivot type which is tilted by a cam, with one end in the longitudinal direction being a supporting point, to open and close a valve. Moreover, a roller is mounted in a body of the rocker arm. The body has a pair of opposed side walls and a connecting wall which connects the side walls. These walls are formed by bending one metal plate into a U-shape. A valve fitting section is provided in one end area in the longitudinal direction of the connecting wall, and a pivot receiver is provided in the other end area in the longitudinal direction of the connecting wall. An upper end of the valve is fitted into the valve fitting section, and an upper end of a pivot section provided on a cylinder head is fitted into the pivot receiver.

The roller is supported rotatably between the pair of side walls via a supporting shaft in a state that a part of the roller protrudes from a through hole provided in a middle portion of the longitudinal direction in the connecting wall.

In this rocker arm, the valve fitting section of the body is formed in the following manner. The body is bent so as to have a substantially U-shaped section, and the one connecting wall of the body is pushed up to a halfway position in the up-and-down direction of the pair of side walls so as to be bent into a reverse M-shape as viewed from an end surface.

In the prior example, the valve fitting section of the body is obtained by forcibly bending the body into the reverse M shape. For this reason, as shown in FIGS. 8A through 8C, for example, crazing, which causes lowering of strength, and a sink mark, which causes lowering of shape accuracy, easily occur on an outer surface of the bent section of the pair of side walls 51 and 52 and the connecting wall 53. Additionally, the sink mark varies a width dimension W of the valve fitting section 50 which results in increases in a generation rate of defective products.

SUMMARY OF THE INVENTION

Therefore, it is an object of the present invention to provide a rocker arm which has a form such that a valve fitting section formed on a body made of sheet metal can be processed without generation of defects such as crazing and sink marks and relates to a method of fabricating the body of the rocker arm.

The other objects features and advantages of the invention will become clear from the following text read in conjunction with the drawings.

A rocker arm of the present invention, for opening and closing a valve when tilted by a cam, which is provided on a cylinder head has a body made of sheet metal which is obtained by bending one metal plate into a substantially U shape so as to form a pair of opposed side walls and connecting walls for connecting the side walls. A convex valve fitting section, which has a convex lower side for contacting the valve stem and an opposing concave upper side, is formed in one of the connecting walls of the body by press working including a process for forming a non-uniform cross section due to plastic flow.

According to the rocker arm of the present invention, the valve fitting section of the body is obtained not by the bending process but by press working including the non-uniform cross section processing. For this reason, crazing and sink mark do not occur, and a width dimension of the valve fitting section can be managed accurately.

The rocker arm of the present invention is preferably constituted so that the connecting walls have an surrounding area adjacent where the valve fitting section will be formed which is a circumferential section, and a thickness of the area where the valve fitting section will be formed is increased by the non-uniform cross section processing for plastically flowing material of the circumferential section to the area where the valve fitting section will be formed, and the valve fitting section is then formed in the thickened area.

The rocker arm of the present invention is preferably constituted so that the connecting wall has a pair of protruded walls, and the protruded walls are protruded by the non-uniform cross section process for plastically flowing the sections of the side walls, and between the protruded sections is the convex valve fitting section.

A method of fabricating a rocker arm body according to the present invention, the body being made of sheet metal and being provided with a pair of opposed side walls and connecting walls for connecting the side walls, the rocker arm opening and closing a valve when tilted by a cam and provided on a cylinder head, includes the first step of obtaining a developed form of the body from one metal plate; and the second step of forming a convex valve fitting section on one of the connecting walls of the body by means of press working including a non-uniform cross section process inducing plastic flow.

According to the fabricating method of the present invention, since the valve fitting section of the body is formed by press working including the non-uniform cross section process, crazing and a sink mark do not occur. For this reason, the rocker arm body can be fabricated having a width dimension of the valve fitting section that can be managed accurately.

In the method of fabricating the rocker arm body according to the present invention, the second step plastically flows sections of the side walls on both sides of the connecting walls in an area where a valve fitting section will be formed to the area where the valve fitting section will be formed so as to increase a thickness of the area where the valve fitting section will be formed, and sinks the thickened areas where the valve fitting section will be formed so as to form the convex valve fitting section.

In the method of fabricating the rocker arm body according to the present invention, the second step plastically flows at least sections of the side walls of the body so as to form a pair of opposed protruded walls, and between the protruded walls is the convex valve fitting section.

BRIEF DESCRIPTION OF THE DRAWINGS

These and other objects as well as advantages of the invention will become clear by the following description of preferred embodiments of the invention with reference to the accompanying drawings, wherein.

In all these figures, like components are indicated by the same numerals.

DETAILED DESCRIPTION OF THE INVENTION

Figure 1:
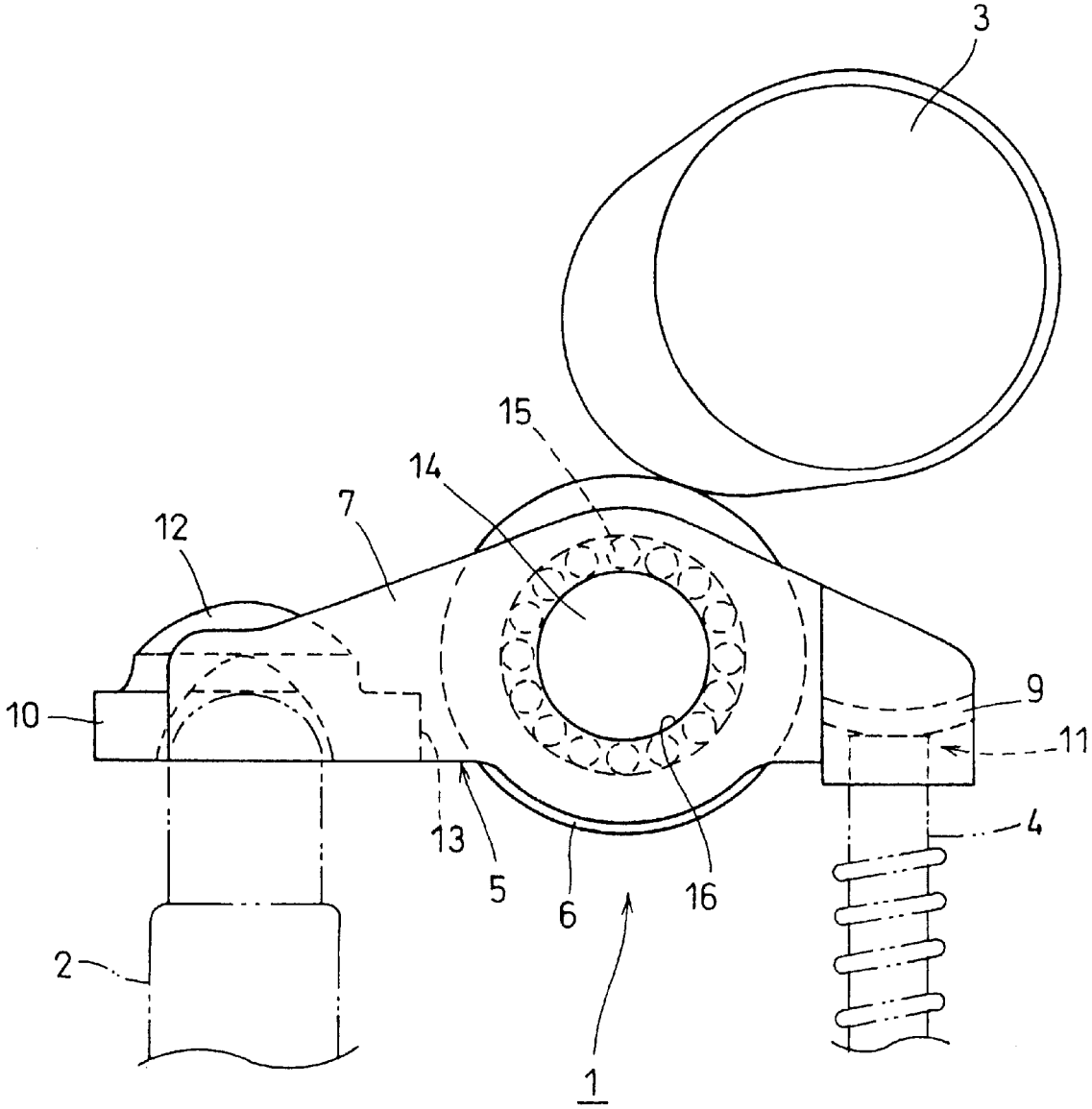
FIG. 1 is a side view of a rocker arm according to a preferable embodiment of the present invention.
Figure 2:
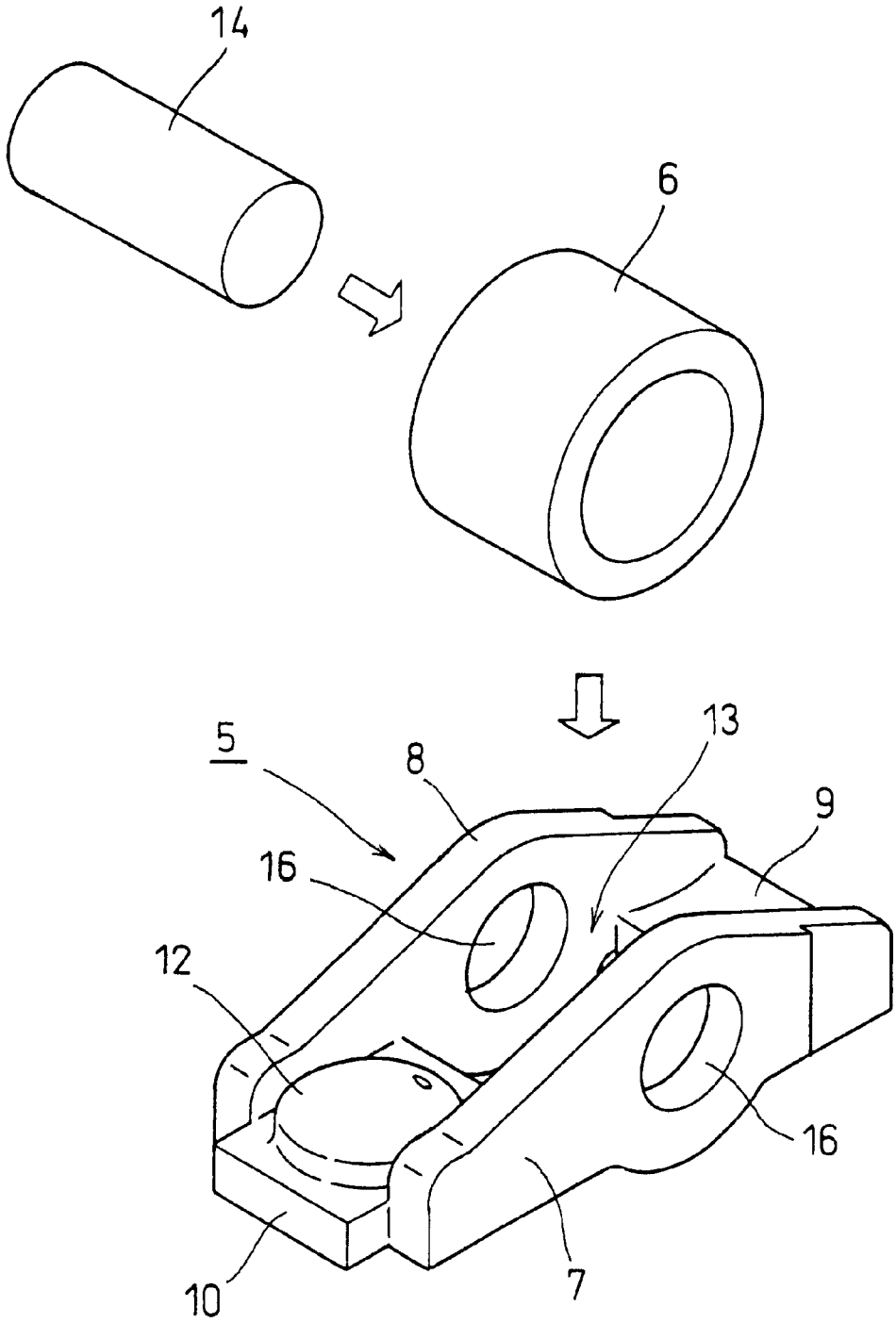
FIG. 2 is an exploded perspective view of the rocker arm of FIG. 1.
Figure 3:
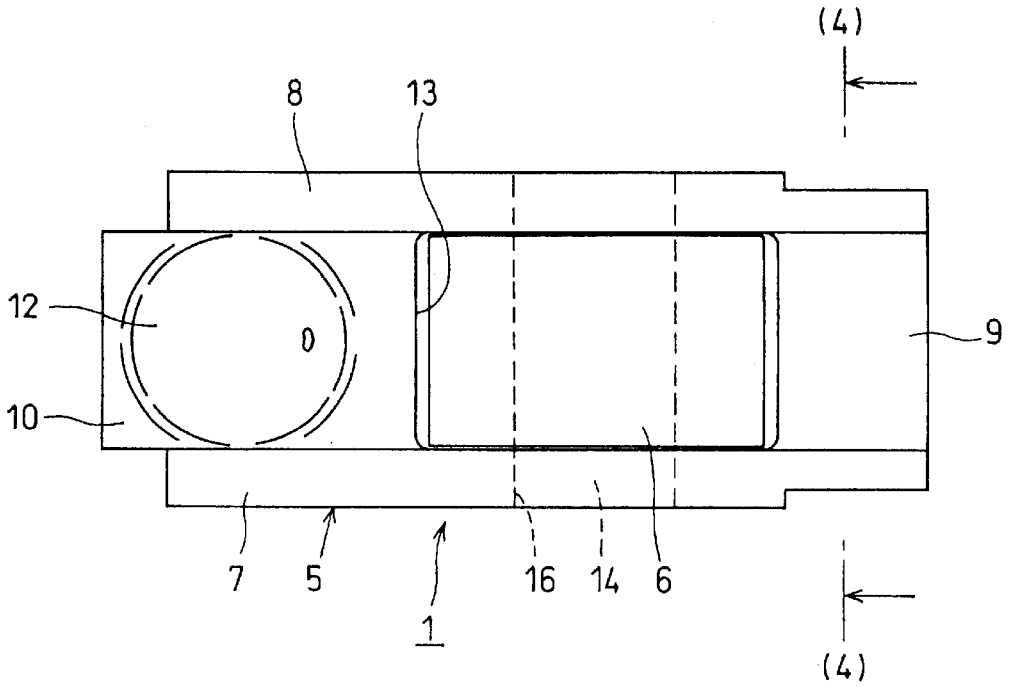
FIG. 3 is a plan view of the rocker arm of FIG. 1.
Figure 4:
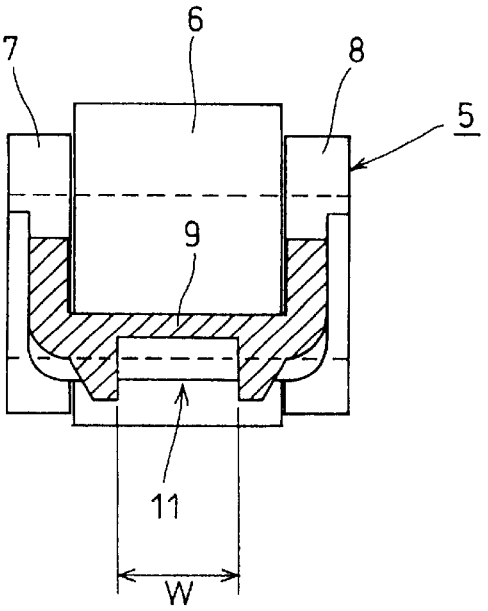
FIG. 4 is a fragmentary view taken on the line (4)—(4) of FIG. 3.

There is explained below preferable embodiments of the present invention with reference to the drawings.

As shown in FIGS. 1 through 5, a rocker arm 1 is of an end pivot type which is tilted by a cam 3 having one end of a longitudinal direction supported by a rush adjuster 2 and which opens and closes a valve 4. The rocker arm 1 is composed of two elements, a body 5 and a roller 6.

The body 5 has a pair of opposed band-shaped side walls 7 and 8 and two connecting walls 9 and 10. A convex valve fitting section 11 which receives an upper end of the valve 4 is provided in the connecting wall 9 on one end of the longitudinal direction. A hemispheric convex shaped pivot receiver 12 which receives an upper end of the rush adjuster 2 in a concave underside is provided in the connecting wall 10 on the other end of the longitudinal direction. This structure of the body 5 is obtained by bending one metal plate blank so that its cross section becomes substantially U shape by means of press working.

The valve fitting section 11 is formed in the connecting wall 9 of the body 5 convex shaped surface by means of the press working which includes a non-uniform cross section process producing plastic flow of material.

The roller 6 is supported rotatably between the pair of side walls 7 and 8 of the body 5 via a supporting shaft 14 and a plurality of needle rollers 15. In the state that roller 6 is supported, its outer circumferential edge protrudes from a through hole 13 provided between the two connecting walls 9 and 10.

The valve fitting section 11 of the body 5 is formed such that defects such as crazing and sink marks which arise as a problem in a usual bending process do not occur. For this reason, variation of strength and form accuracy due to the defects can be eliminated from the rocker arm having the above structure.

There is explained below a method of fabricating the body 5.

Figures 5A, 5B, 5C, 5D:
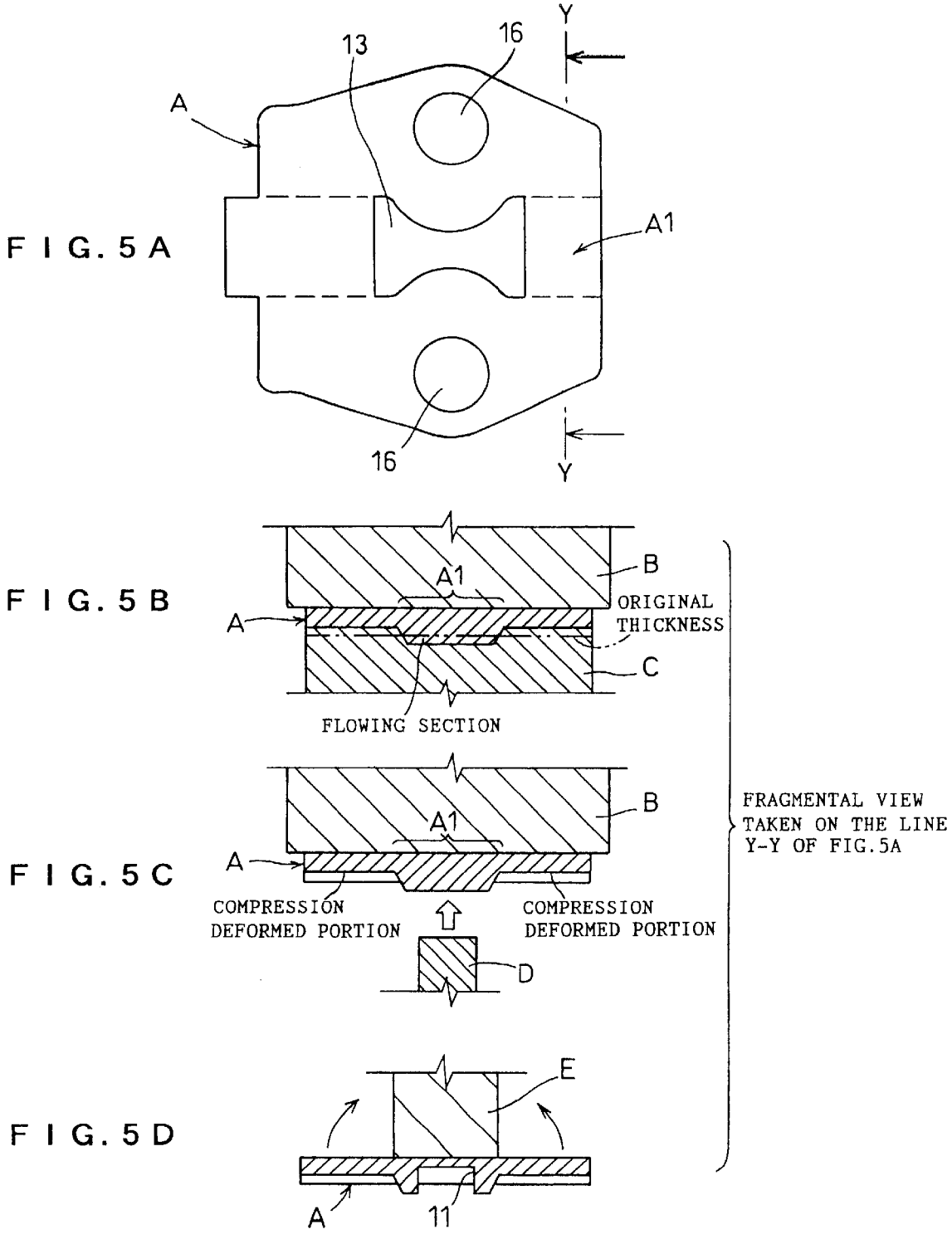
FIG. 5A is a plan view of a metal sheet blank formed for fabricating the rocker arm body of FIG. 1.
FIG. 5B is a fragmentary view taken on the line Y—Y of FIG. 5A showing a non-uniform cross section process which is executed to form a connecting wall.
FIG. 5C is a fragmentary view taken on the line Y—Y of FIG. 5A showing the state after the non-uniform cross section process which is executed to form the connecting wall.
FIG. 5D is a fragmentary view taken on the line Y—Y of FIG. 5A showing a bent form of a circumferential section of the connecting wall.

One metal plate blank A is die-cut by press working so as to have an outer form shown in FIG. 5A. At this time, the through hole 13 and through holes 16 of the supporting shaft 14 are formed in necessary areas of the metal plate blank A.

Thereafter, as for an area Al of the metal plate blank A where the valve fitting section 11 is formed, as shown in FIG. 5B, a adjacent portions of the area A1 are pressurized and compressed by press working using a first bearing die B and a first embossing die C. This process makes a thickness of the adjacent portions of the area A1 thinner than an original thickness (shown by a hypothetical line). As a result, a material which plastically flows due to the pressuring-compressing process is collected in the area A1 so that the thickness of the area A1 becomes thicker than the original thickness (in this specification, this process is the non-uniform cross section process).

The area A1 which is made to be thicker in such a manner is, as shown in FIG. 5C, half-blanked by press working using a second embossing die D. As a result, as shown in FIG. 5D, the valve fitting section 11 having convex shape is sank upward. A ceiling section of an inner surface of the valve fitting section 11 is curved into a semi-arc form, and this shape is formed in such a manner that an end surface shape of the second embossing die D is transferred.

Both side portions of the metal plate A are, as shown in FIG. 5D, bent by press working using a second bearing die E so as to be bent into a substantially U-shape along a broken line of FIG. 5A. As a result, the pair of side walls 7 and 8 and the connecting walls 9 and 10 are formed.

As not shown, the hemispheric pivot receiver 12 which is protruded upward from the connecting wall 10 on the other side of the longitudinal direction is obtained by a drawing process using press working. The through holes 16 may be formed after the bending process of the side walls 7 and 8 or the pivot receiver 12 may be formed before the bending process of the side walls 7 and 8.

As explained above, the valve fitting section 11 is obtained by the half-blanking process in such a manner that the one connecting wall 9 is made to be thick and is sunk into a concave shape on an upper side thus providing a convex surface on a lower side for contacting the valve. For this reason, the defects such as crazing and sink marks which become a problem in the forcible bending process described in the prior example do not occur, namely, the varying of strength and form accuracy due to the defects can be eliminated. As a result, fabricating yield can be improved in the body 5 of the rocker arm 1, namely, productivity can be improved and fabricating costs can be reduced.

Furthermore, since the inner surface of the valve fitting section 11 can be obtained by shearing included in the halfblanking process, the width dimension W can be managed accurately. As a result, the operability of the valve 4 by means of the valve fitting section 11 becomes stable, namely, the stability of the operation of the valve 4 can be improved.

The present invention is not limited to the above-mentioned concrete example, and various applications and modifications are considered to be within the scope of the present invention.

Figure 6:
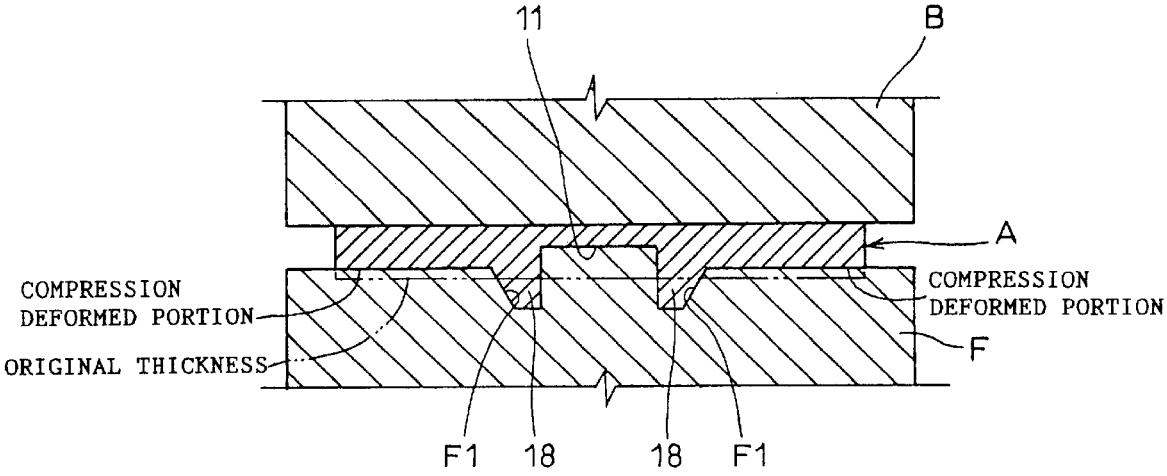
FIG. 6 is a diagram showing another example of processing of a valve fitting section.

(1) In the above example, the two embossing dies C and D are used separately in the step of forming the valve fitting section 11, but a single embossing die F shown in FIG. 6 can be used. Namely, one surface of each of the side walls 7 and 8 is compressed so that the thickness becomes thinner by press working using the single embossing die F. Accordingly, sections which plastically flow are gathered into cavity portions F1 of the embossing die F so that a pair of protruded walls 18 which form the convex valve fitting section 11 are provided on an inner side of one surface of the connecting wall 9. In this case, since a number of the processing steps can be reduced more than the above embodiment, this is advantageous to reducing of the fabricating costs. Further, since the protruded walls 18 are formed by the cavities F1 of the embossing die F, variations of form can be eliminated.

Figure 7A:
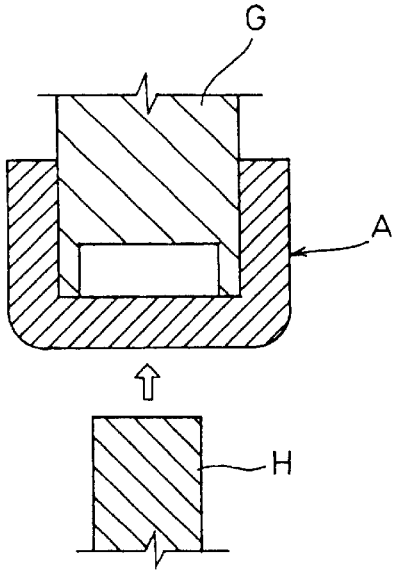
FIG. 7A is a cross section showing another example of processing of the valve fitting section and a half blanking process to be executed to form the connecting wall by means of press working.
Figure 7B:
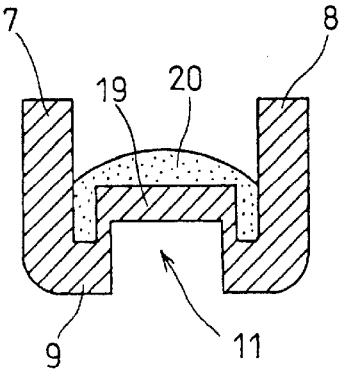
FIG. 7B is a cross section corresponding to FIG. 7A showing stamping of a metal material to form a protruded section of the connecting wall.
Figure 8A:
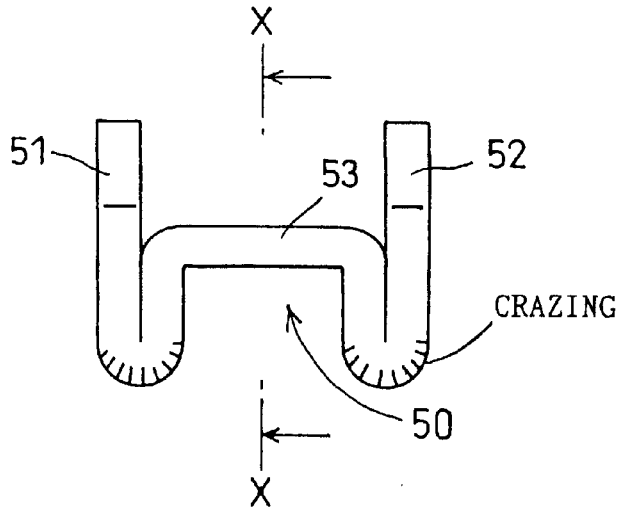
FIG. 8A is a front view showing a main section of a body having side walls and a connecting wall and a defect of a prior rocker arm.
Figure 8B:
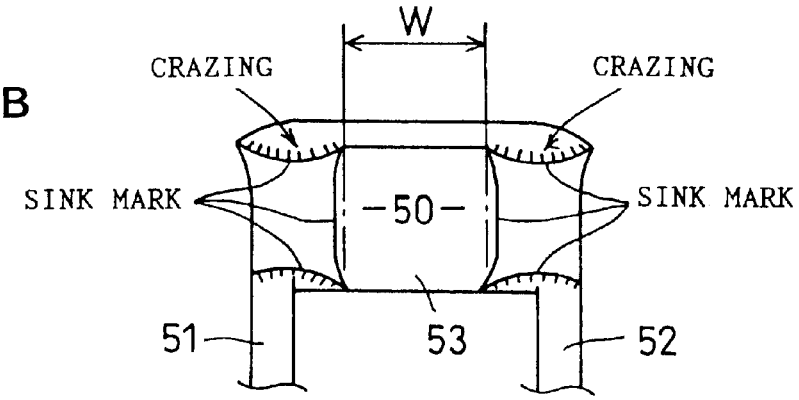
FIG. 8B is a bottom view of the main section of the body of FIG. 8A.
Figure 8C:
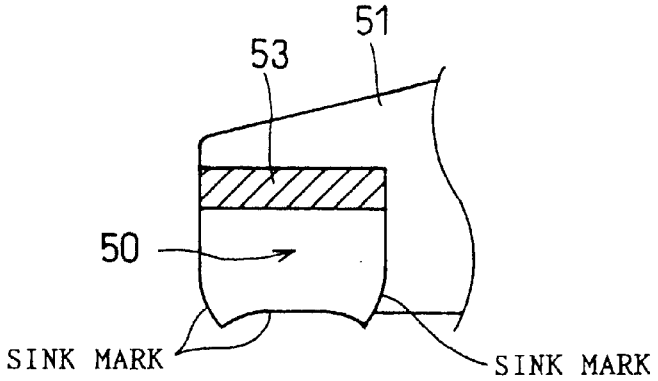
FIG. 8C is a fragmentary view taken on the line X—X of FIG. 8A.

(2) In the above example, the thickness of the connecting wall 9 is made to be thicker and the half-blanking process is executed so that the valve fitting section 11 is formed. However, it can be processed by a manner shown in FIGS. 7. Namely, as shown in FIG. 7A, one metal plate blank A is bent into a substantially U shape, and the one connecting wall 9 is half-blanked by press working using a bearing die G having a concave section and an embossing die H. As a result, the one connecting wall 9 is protruded to a direction which is the same as a raising direction of the pair of side walls 7 and 8 so that the protruded section 19 is formed. Accordingly, the inner space of the protruded section 19 is sunk so that the convex valve fitting section 11 is formed. As shown in FIG. 7B, a metal material (wax) 20 is joined to the connecting wall 9 so as to cover the whole outer surface of the protruded section 19. In such a manner, the valve fitting section 11 has a reinforced structure.

(3) In the above example, the roller 6 is supported on the supporting shaft 13 via the plurality of needle rollers 14, but it can be supported rotatably by sliding contact without using the needle rollers 14. Namely, the roller 6 can be fitted directly onto the supporting shaft, or as not shown, it can be fitted thereinto with loose fit via a slide bearing such as a bushing.

(4) The above concrete example exemplified the end pivot type rocker arm 1, but as not shown, the present invention can be applied also to a center pivot type rocker arm.

While there has been described what is at present considered to be preferred embodiments of this invention, it will be understood that various modifications may be made therein, and it is intended to cover in the appended claims all such modifications as fall within the true spirit and the scope of this invention.

What is claimed is:

1. A method of fabricating a rocker arm body made of sheet metal and having a pair of side walls and first and second connecting walls interconnecting the side walls, the method comprising the steps of:

providing a sheet metal blank of uniform initial thickness configured to define side wall sections and first and second connecting wall sections interconnecting the said wall sections;

press working the sheet metal blank to plastically flow metal from at least portions of the side wall sections into the first connecting wall section such that the first connecting wall section becomes thicker than the uniform initial thickness and the at least portions of the side walls become thinner than the uniform initial thickness and to form the first connecting wall section into a convex valve fitting section; and orienting the side wall sections to extend at an angle from the convex valve fitting section.

2. The method of claim 1, wherein the side wall sections are oriented by bending both the side wall sections in a direction in which the convex valve fitting convexly extends to form said pair of side walls.

3. The method of claim 1, wherein the press working plastically flows material from the at least portions of the side wall sections to form a pair of opposed protruded walls with the convex valve fitting section therebetween.

4. The method of claim 3, wherein the protruded walls extend from a concave side of the convex valve fitting section and the side wall sections are oriented by bending both the side wall sections in a direction opposite that of the protruded walls and in a direction in which the convex valve fitting convexly extends to form said pair of side walls.

5. The method of claim 1, wherein the at least portions of the side wall sections are portions of the side walls and the press working plastically flowing material from the portions of the side wall sections results in the portions of the side wall sections being thinner than remaining portions of the side wall sections such that a width of the rocker arm is narrower at said portions of the side wall sections than at the remaining portions of the side wall sections.

6. The method of claim 3, wherein the at least portions of the side wall sections are portions of the side walls and the press working plastically flowing material from the portions of the side wall sections results in the portions of the side wall sections being thinner than remaining portions of the side wall sections such that a width of the rocker arm is narrower at said portions of the side wall sections than at the remaining portions of the side wall sections.

7. A method of fabricating a rocker arm body made of sheet metal and having a pair of side walls and first and second connecting walls interconnecting the side walls, the method comprising the steps of:

providing a sheet metal blank of uniform initial thickness configured to define side wall sections and first and second connecting wall sections interconnecting the said wall sections;

first press working the sheet metal blank to plastically flow metal from at least portions of the side wall sections into the first connecting wall section such that the first connecting wall section becomes thicker than the uniform initial thickness and the at least portions of the side walls become thinner than the uniform initial thickness;

orienting the side wall sections to extend at an angle from the first and second connecting wall sections; and second press working the sheet metal blank to plastically flow metal to form the first connecting wall section into a convex valve fitting section with a convex side extending between the side walls.

8. The method of claim 7, wherein the second press working plastically flows material from the first connecting wall section to form a pair of opposed protruded walls extending from a concave side of the convex valve fitting section therebetween.

9. The method of claim 8, wherein the at least portions of the side wall sections are portions of the side walls and the press working plastically flowing material from the portions of the side wall sections results in the portions of the side wall sections being thinner than remaining portions of the side wall sections such that a width of the rocker arm is narrower at said portions of the side wall sections than at the remaining portions of the side wall sections.

10. The method of claim 7, wherein the at least portions of the side wall sections are portions of the side walls and the press working plastically flowing material from the portions of the side wall sections results in the portions of the side wall sections being thinner than remaining portions of the side wall sections such that a width of the rocker arm is narrower at said portions of the side wall sections than at the remaining portions of the side wall sections.

11. A rocker arm body comprising:

a pair of side walls opposing each other and each having a first side wall portion and a second side wall portion;

first and second connecting walls respectively interconnecting the first side wall portions and the second side wall portions; and said first connecting wall having a convex valve fitting section a convex side extending between the first side wall portions;

wherein the first side wall portions are formed thinner than the second side wall portions such that a width of the rocker arm is narrower at said first side wall portions than at the second side wall portions.

12. The rocker arm body of claim 7, further comprising a pair of opposed protruded walls extending from a concave side of the convex valve fitting section.

* * * * *